US007586045B2

(12) United States Patent
Kim et al.

(10) Patent No.: US 7,586,045 B2
(45) Date of Patent: Sep. 8, 2009

(54) METHOD FOR FABRICATING ELECTRODE OF EXTERNAL ELECTRODE FLUORESCENT LAMP AND EXTERNAL ELECTRODE FLUORESCENT LAMP HAVING ELECTRODE FABRICATED BY THE METHOD

(75) Inventors: Dong-Gil Kim, Seoul (KR); Young-Chul Lee, Yongin-si (KR); Sung-Jung Kim, Seoul (KR); Sung-Hae Kim, Suwon-si (KR)

(73) Assignee: DMS Co., Ltd., Kyungki-do (KR)

( * ) Notice: Subject to any disclaimer, the term of this patent is extended or adjusted under 35 U.S.C. 154(b) by 230 days.

(21) Appl. No.: 11/584,918

(22) Filed: Oct. 20, 2006

(65) Prior Publication Data

US 2007/0090763 A1 Apr. 26, 2007

(30) Foreign Application Priority Data

Oct. 21, 2005 (KR) ..... 10-2005-0099524
Dec. 20, 2005 (KR) ..... 10-2005-0126314

(51) Int. Cl.
*H01B 5/14* (2006.01)

(52) U.S. Cl. ..... 174/126.4; 313/607

(58) Field of Classification Search ..... 174/126.1, 174/126.4; 313/607, 608, 631
See application file for complete search history.

(56) References Cited

U.S. PATENT DOCUMENTS

2005/0189879 A1* 9/2005 Minamoto et al. ..... 313/607
2005/0218783 A1* 10/2005 Kim et al. ..... 313/491
2006/0076893 A1* 4/2006 Murakami et al. ..... 313/607

FOREIGN PATENT DOCUMENTS

CN 1129841 A 8/1996
CN 1622278 A 6/2005
CN 1643649 A 7/2005
JP 2004-146351 A 5/2004
JP 2004-199992 A 7/2004
JP 2004-207069 A 7/2004
JP 2006-040857 A 2/2006
JP 2006-085983 A 3/2006
JP 2006-507626 A 3/2006

* cited by examiner

*Primary Examiner*—Chau N Nguyen
(74) *Attorney, Agent, or Firm*—Ladas & Parry LLP

(57) ABSTRACT

A method of fabricating an electrode of an external electrode fluorescent lamp (EEFL) includes plating nickel on both ends of a glass tube through an electroless nickel plating process and forming electrodes by dipping the glass tube into an electrode material including zinc, and tin or lead.

4 Claims, 6 Drawing Sheets

METHOD FOR FABRICATING ELECTRODE OF EXTERNAL ELECTRODE FLUORESCENT LAMP AND EXTERNAL ELECTRODE FLUORESCENT LAMP HAVING ELECTRODE FABRICATED BY THE METHOD

CROSS-REFERENCES TO RELATED APPLICATION

This application claims priority to and the benefit of Korean Patent Application Nos. 10-2005-0099524 filed on Oct. 21, 2005, and 10-2005-0126314 filed on Dec. 20, 2005, both applications filed in the Korean Intellectual Property Office, the entire contents of which are incorporated herein by reference.

BACKGROUND OF THE INVENTION

1. Field of the Invention

The present invention relates to a method for fabricating an electrode of an external electrode fluorescent lamp (EEFL) and, more particularly, to a method of fabricating an electrode of an EEFL that can be applied to a backlight unit used as a light source of a flat display device, wherein the method can easily form an electrode of a phosphor lamp to improve the quality and productivity of the fluorescent lamp and can improve the hardness of the external electrode. The present invention further relates to an EEFL having an electrode fabricated using the method.

2. Description of Related Art

Generally, an EEFL includes a glass tube in which a discharge gas, which is a mixture of neon and argon, and mercury are injected. The EEFL has a fluorescent layer formed on the inside wall of the glass tube, and external electrodes are disposed at both ends of the EEFL. An external electric power source may be provided to the external electrodes for causing an electric discharge of the EEFL. The external electrodes may be formed by dipping both ends of the EEFL into a ceramic solder bath in which tin, zinc, aluminum, antimony, and the like are added for a certain period. However, a protective cap covers each external electrode of the EEFL to protect the external electrodes. The protective cap may be formed of a material such as brass electroplated with nickel, or SUS. The protective caps cover the external electrodes after coating silver or carbon pastes on the electrodes. Then, the protective caps are heated by, for example, ultrasonic waves, so that the protective caps are firmly connected with the glass tube.

The protective caps make the manufacturing process of the EEFL complicated. Particularly, the manufacturing cost is increased since the protective cap needs to be prepared as an additional part.

In addition, after the dipping process is performed, pores may be formed during hardening of the ceramic solder. Therefore, in order to minimize the generation of the pores, vibration is applied during the dipping using an ultrasonic wave generator.

As described above, when using the ultrasonic wave generator, the generation of pores can be reduced. However, due to high viscosity of the protective cap material, the ultrasonic waves cannot propagate to a sufficient distance, and therefore, a large-sized ultrasonic wave generator has to be used in order to increase ultrasonic wave propagation efficiency.

SUMMARY OF THE INVENTION

Therefore, the present invention has been made in an effort to solve the above-described problems.

It is an object of the present invention to provide a method of fabricating an external electrode of an EEFL, which can produce the electrode easily to improve productivity and can form the external electrode without requiring an additional part to reduce the manufacturing cost.

According to the present invention, there is provided a method of fabricating an external electrode of an external electrode fluorescent lamp (EEFL), including plating nickel on both ends of a glass tube through an electroless nickel plating process, and forming electrodes by dipping the glass tube into an electrode material including zinc, and tin or lead.

The method may further include heat-treating the nickel plating layer plated on the glass tube after the plating of nickel on both ends is conducted.

Preferably, the heat treatment may be conducted at a temperature within a range of 300-400° C.

Preferably, a thickness of the nickel plating layer may be within a range of 3-6 m.

According to the present invention, there is provided a method of fabricating an external electrode of an EEFL, including sintering silver or carbon paste adhered to external electrode forming portions that are both ends of the glass tube, and plating nickel on the external electrode forming portions through an electroless nickel plating process.

The method may further include heat-treating the nickel plating layer plated on the glass tube after the plating of nickel on both ends is conducted.

According to the present invention, there is provided an EEFL including: a glass tube; and external electrodes formed on both ends of the glass tube, wherein the external electrodes each include a nickel layer disposed on an outer surface of the glass tube, and a zinc-tin or zinc-lead layer formed on the nickel layer.

According to the present invention, there is provided an EEFL including: a glass tube; and external electrodes formed on both ends of the glass tube, wherein the external electrodes each include a silver or carbon layer disposed on an outer surface of the glass tube, and a nickel layer formed on the silver or carbon layer.

The EEFL may further include a zinc-tin or zinc-lead layer disposed on the nickel layer.

According to the present invention, there is provided an EEFL including: a nickel layer that is plated on a surface of an end of a glass tube through an electroless nickel plating process; an interlayer formed on the nickel layer to improve electrical conductivity; and a protective layer formed on the interlayer to protect the interlayer.

The interlayer may be selected from the group consisting of an electroless copper plating layer, an electroplating copper layer, an electroless platinum plating layer, and an electroplating platinum layer.

The protective layer may be one of an electroless nickel plating layer and an electroplating nickel layer.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather these embodiments are provided so that this disclosure will be thorough and complete, and will fully convey the concept of the invention to those skilled in the art.

Figure 1:
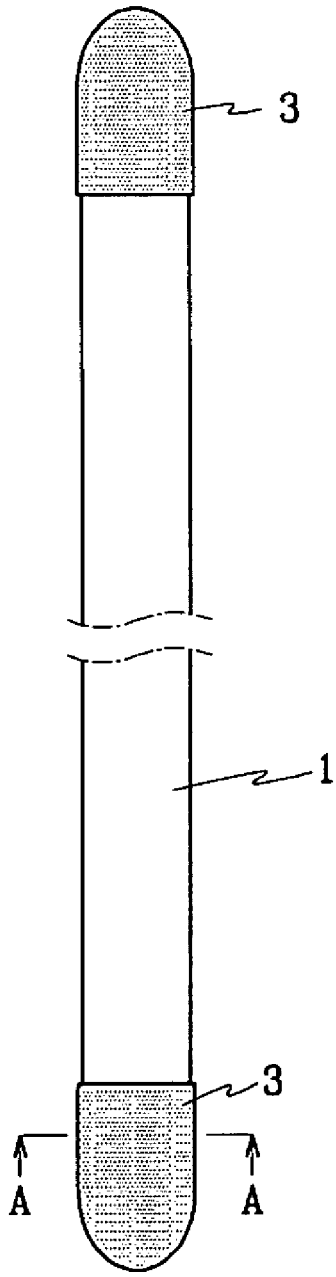
FIG. 1 is a view partly showing a fluorescent lamp according to an embodiment of the present invention.
Figure 2:
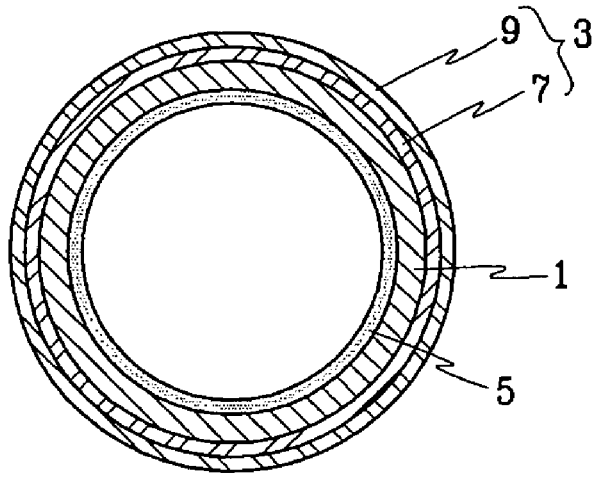
FIG. 2 is a sectional view taken along line A-A of FIG. 1.

FIG. 1 is a view partly showing a fluorescent lamp according to an embodiment of the present invention and FIG. 2 is a sectional view taken along line A-A of FIG. 1.

Referring to FIGS. 1 and 2, an EEFL includes a glass tube 1 in which a discharge gas is filled and external electrodes 3 formed at both ends of the glass tube 1. A fluorescent layer 5 is formed on an inside wall of the glass tube 1, and the fluorescent layer 5 emits light when an electric discharge occurs in the glass tube 1. As shown in FIG. 2, each external electrode 3 includes a nickel layer 7 disposed on an outer surface of the glass tube 1 and a zinc-tin layer 9 disposed on the nickel layer 7. Instead of the zinc-tin layer 9, a lead layer may be disposed on the nickel layer 7. The zinc-tin layer 9 has excellent corrosion resistance and thus prevents oxidation of the external electrodes.

Figure 3:
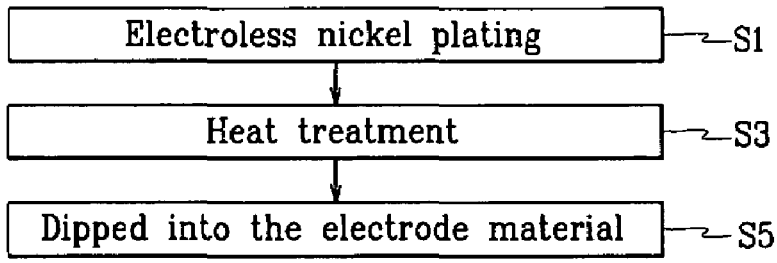
FIG. 3 is a flowchart illustrating a method of forming an external electrode of an EEFL according to an embodiment of the present invention.

FIG. 3 shows a method of producing the external electrodes of the EEFL.

As shown in FIG. 3, electroless nickel plating is first performed at both ends of the glass tube (S1). The electroless nickel plating may be preformed using a conventional method, which precipitates metal on a surface of an object by reducing metal ions in a metal salt solution using a reducing agent without an external electric power source with autocatalysis. That is, the electroless plating may be conducted by dipping the ends of the glass tube into a plating bath containing an electroless plating solution such as nickel. The plating bath has a temperature maintaining heater.

Then, in order to increase the bonding force between the glass tube 1 and the nickel layer 7, heat treatment is processed (S3). The heat treatment (sintering) temperature is preferably within a range of 300-400° C. The bonding force between the glass tube 1 and the nickel layer 7 may not be sufficiently increased at a temperature below 300° C., while the glass tube 1 may be melted above 400° C. If necessary, the heat treatment process may be omitted.

After the heat treatment process is conducted, the glass tube is dipped into the electrode material including zinc, and tin or lead (S5).

Figure 4:
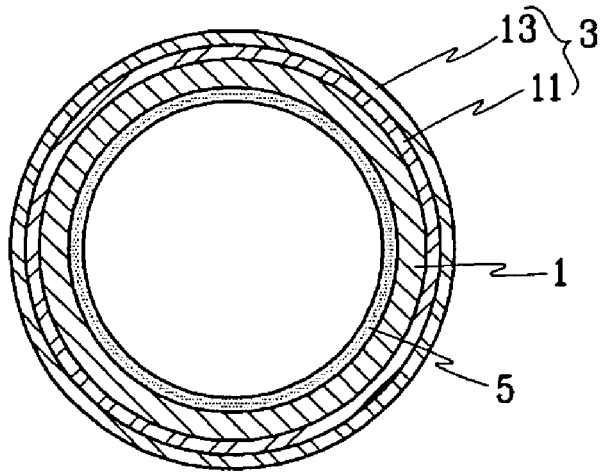
FIG. 4 is a sectional view of a fluorescent lamp according to another embodiment of the present invention.
Figure 5:
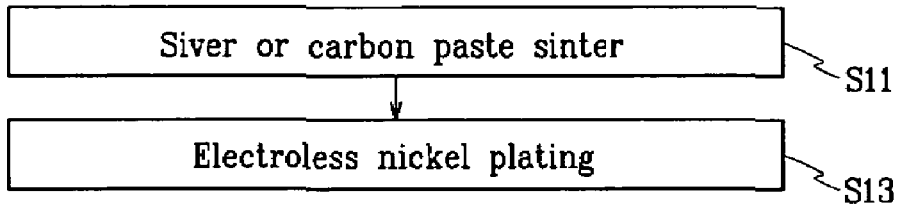
FIG. 5 is a flowchart illustrating a method of fabricating an external electrode according to another embodiment of the present invention.

FIG. 4 is a sectional view of a fluorescent lamp according to another embodiment of the present invention, and FIG. 5 is a flowchart illustrating a method of fabricating an external electrode according to another embodiment of the present invention.

Referring to FIG. 4, a silver or carbon layer 11 is disposed on an outer surface of an end of the glass tube 1, and a nickel layer 13 (here, a different reference number from that of the foregoing embodiment is used for convenience) is formed on the glass tube 1. A method of fabricating the external electrode of the EEFL will now be described.

Silver or carbon paste is adhered on the outer surface of the end of the glass tube, then sintered (S11). That is, in a state where the silver or carbon paste contacts the end of the glass tube, it is sintered at a predetermined temperature. Then, the nickel layer 13 (see FIG. 4) is formed through electroless nickel plating S13.

A thickness of the nickel layer 7, 13 is preferably about 5 □m. That is, the thickness range of the nickel layer 7, 13 is preferably 3~6 □m. The electroless nickel plating forms a plating layer that is dense and has a uniform thickness and high hardness.

According to the above embodiments of the present invention, the external electrodes may be formed by dipping the glass tube into a zinc, and tin or lead solution, after forming the electroless nickel plating layer.

Therefore, the external electrodes of the EEFL formed by the above-described methods may be produced easily by electroless plating, thereby improving productivity. Also, the external electrodes include the nickel layer 7, 13 having high hardness, and thus no separate protective cap is required. Therefore, the number of parts may be reduced, thereby reducing the manufacturing cost.

Figure 6:
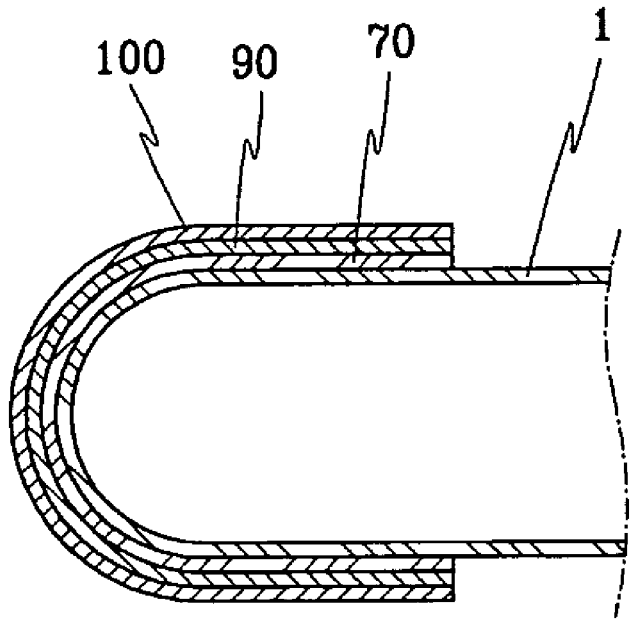
FIG. 6 is a sectional view of an external electrode according to another embodiment of the present invention.

FIG. 6 is a sectional view of an external electrode according to another embodiment of the present invention.

Referring to FIG. 6, a nickel layer 70 is formed by electroless nickel plating on an outer surface of both ends of a glass tube 1, and an interlayer 90 is formed on the nickel layer 70 through electroless plating or electroplating. The interlayer 90 is formed of a material such as copper or platinum that has excellent electrical conductivity.

A protective layer 100 is formed on the interlayer 90 in order to prevent damage from an external physical cause.

The protective layer 100 may be formed by electroless plating or electroplating of nickel, which has relatively high hardness.

Therefore, the external electrodes of the EEFL, according to the present invention, are formed by electroless nickel plating, which may have a simple fabricating method, thereby improving productivity. Also, the plated nickel has high hardness and thus no separate protective cap is required. Therefore, the number of parts may be reduced and thus the manufacturing cost can be reduced.

In addition, when the external electrodes are formed by electroless plating or electroplating, the glass tubes may be set in a cassette to mass-produce the electrodes simultaneously. Also, the plating is conducted directly on the glass tube and thus the ultrasonic wave generator that has been used in the prior art to reduce the generation of pores is not required.

What is claimed is:

1. An EEFL comprising:

a glass tube; and external electrodes formed on both ends of the glass tube, wherein the external electrodes each consist of a nickel layer disposed on an outer surface of the glass tube, and a zinc-tin or zinc-lead layer formed on the nickel layer.

2. An EEFL comprising:

a nickel layer that is plated on a surface of an end of a glass tube through an electroless nickel plating process;

an interlayer formed on the nickel layer to improve electrical conductivity; and a protective layer formed on the interlayer to protect the interlayer;

wherein the nickel layer covers the whole surface of the end of the glass tube;

wherein the interlayer covers the whole surface of the nickel layer and wherein the protective layer covers the whole surface of the interlayer.

3. The EEFL of claim 2, wherein the interlayer is selected from the group consisting of an electroless copper plating layer, an electroplating copper layer, an electroless platinum plating layer, and an electroplating platinum layer.

4. The EEFL of claim 2, wherein the protective layer is one of an electroless nickel plating layer and an electroplating nickel layer.

* * * * *